United States Patent [19]

Loland

[11] 4,249,610

[45] Feb. 10, 1981

[54] OFFSHORE DRILLING CONTROL CABLE CLAMP SYSTEM

[75] Inventor: Sven Loland, Stavanger, Norway

[73] Assignee: Sante Fe International Corporation, Alhambra, Calif.

[21] Appl. No.: 900,083

[22] Filed: Apr. 26, 1978

Related U.S. Application Data

[63] Continuation-in-part of Ser. No. 835,874, Sep. 23, 1977, abandoned.

[51] Int. Cl.[3] ..... E21B 7/12

[52] U.S. Cl. ..... 166/360; 24/132 R; 24/262; 248/74 R; 166/352; 166/359

[58] Field of Search ..... 166/345, 350, 359, 365, 166/366, 367, 362, 360, 352; 175/7; 24/132 R, 81 CC, 262; 285/119, 137 A, 373, 419; 174/47; 248/68 R, 74 R, 229

[56] References Cited

U.S. PATENT DOCUMENTS

| | | | |
|---|---|---|---|
| 2,179,251 | 11/1939 | De Right et al. | 248/229 |
| 2,248,170 | 7/1941 | Hansen | 248/229 |
| 2,705,603 | 4/1955 | Bitz et al. | 248/229 |
| 2,729,756 | 5/1973 | Cook et al. | 166/350 X |
| 3,280,908 | 10/1966 | Todd | 166/345 X |
| 3,538,238 | 11/1970 | Delacour et al. | 175/7 X |
| 3,557,564 | 1/1971 | Hauber | 166/359 |
| 3,740,801 | 6/1973 | Sears, Jr. et al. | 248/74 R X |
| 3,852,943 | 12/1974 | Healy | 24/134 R |
| 3,940,832 | 3/1976 | Kelly | 248/74 R X |
| 3,963,855 | 6/1976 | Hawkins et al. | 24/132 R X |
| 3,982,779 | 9/1976 | Hickey | 285/373 |
| 4,126,183 | 11/1978 | Walker | 166/338 |

*Primary Examiner*—James A. Leppink
*Assistant Examiner*—Richard E. Favreau
*Attorney, Agent, or Firm*—LeBlanc, Nolan, Shur & Nies

[57] ABSTRACT

A cable clamp for securing a control cable to a kill or choke line in a mud riser used in offshore drilling of oil and gas wells is described. The cable clamp is comprised of two portions, a fixed portion which remains secured to the kill or choke line and a removable portion which can be engaged to or quickly released from the fixed portion to secure or disengage the control cable. The fixed portion includes a U-clamp, and the removable portion includes cooperating hinged members, each member mounting resilient pad and both members for securing said hinged members together to clamp said cable.

28 Claims, 9 Drawing Figures

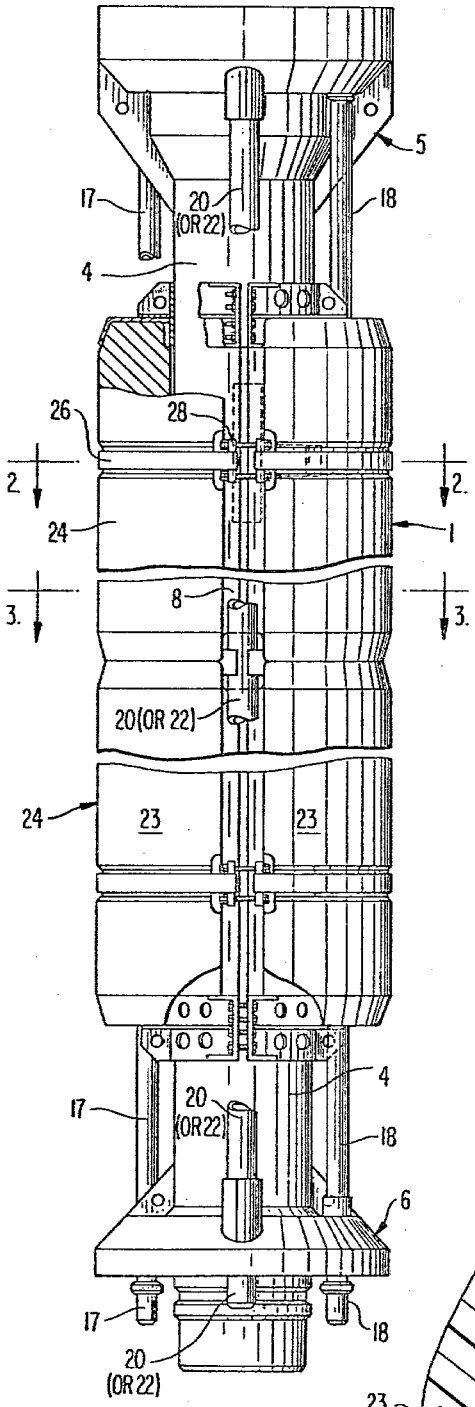
FIG 1
FIG 2.
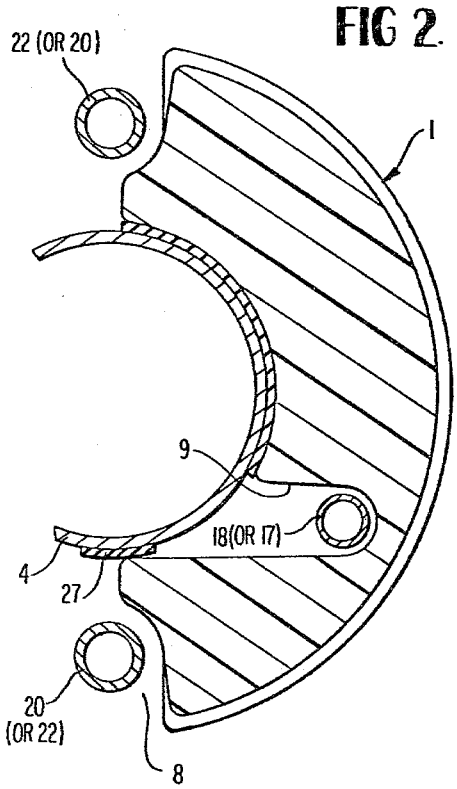
FIG 3
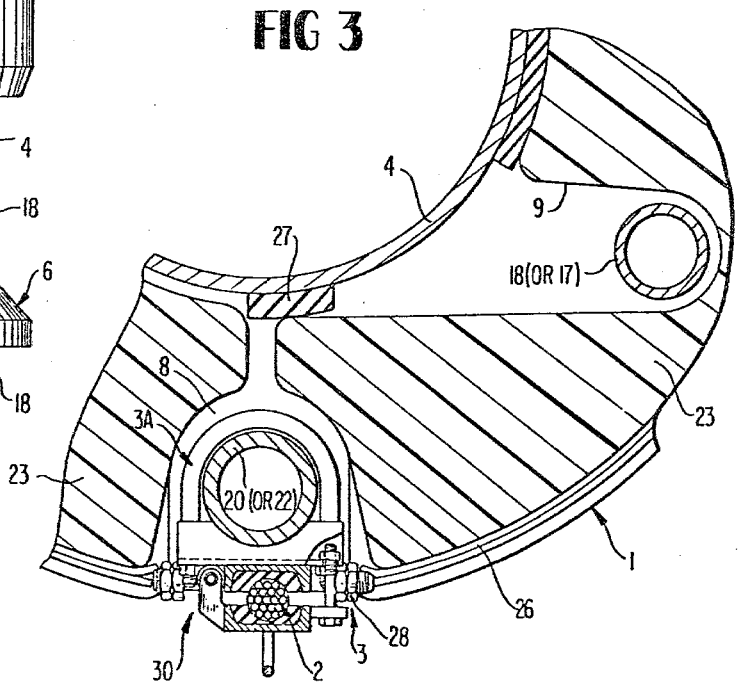

OFFSHORE DRILLING CONTROL CABLE CLAMP SYSTEM

CROSS REFERENCE TO RELATED APPLICATION

This is a Continuation-in-Part of my co-pending earlier filed U.S. Patent Application Ser. No. 835,874 filed Sept. 23, 1977 now abandoned.

FIELD OF INVENTION

This invention relates generally to a novel apparatus for an improved system for offshore drilling of, and producing from, oil and gas wells in deep ocean waters exceeding 1,000 ft and typically ranging 3,000–6,000 ft or more.

More particularly this invention relates to novel control cable clamps used in a novel arrangement with marine riser joints having buoyancy modules thereon for making up a riser string which extends vertically from a blow out preventer ("BOP") installed on the sea floor to control the well up to a drilling vessel at the ocean surface. Control cables extending from the vessel to the BOP are secured to such risers by such clamps so that the weight of such long cables is at least partly vertically supported by the buoyancy modules of the riser string.

BACKGROUND OF THE INVENTION

Offshore drilling of oil and gas wells is being conducted in constantly increasing water depths. Such offshore drilling operations in active ocean and sea oil exploration areas are now being conducted in depths of 1,000 ft to 3,000 ft, and will be conducted at depths of 5,000–6,000 ft in the foreseeable future.

Offshore drilling in deep water is commonly conducted from a column stabilized semisubmersible drilling vessel such as described and discussed in U.S. Patent to Lloyd U.S. Pat. No. Re. 29,167 and in OCEAN INDUSTRY 1976–1977 Directory of Marine Drilling Rigs published Sept. 1976 by Gulf Publishing Co. of Houston Tex. Such drilling vessel is semisubmerged so that the mean waterline of the ocean surface is at approximately one-half the height of the columns and the vessel operates in column stabilized condition with its main deck above the ocean surface, thereby providing a semisubmerged floating platform which supports the drilling rig or derrick used for conducting drilling operations.

Typically the drilling rig or derrick has a main drilling floor disposed above the main deck of the vessel; and a drilling "rotary" located on the main drilling floor of the derrick is a key element in carrying out drilling operations. Such semisubmersible vessels are also provided with a "spider deck" located below the vessel's main deck at a vertical elevation whereby there generally is a distance of about 30 ft between the spider deck and the rotary on the drilling floor of the derrick. The spider deck also is located so that generally this deck is a suitable distance above mean water line of the ocean surface while the vessel is in column stabilized semisubmersible condition for conducting drilling operations.

In drilling a deep water oil or gas well, a "temporary guide base" is installed on the sea floor where the well is being drilled. Then a "conductor pipe", a well head housing, a well head connector, and permanent guide base are installed in cooperation with the temporary guide base, and the same are effectively secured to the ocean floor by cementing the conductor pipe to a hole made in the sea floor during an initial stage of drilling the well.

A blow out preventer stack (sometimes called "BOP" in the trade) is mounted on the permanent guide base in operative relationship with the well head connector to control the well during drilling operations, and particularly to prevent a "blowout" of the well during drilling and/or production.

In a typical oil well drilling operation, the blow out preventer stack (BOP) is lowered from the drilling vessel to the sea floor by means of a series of marine "risers". Typically a riser is 50 ft long and includes a main central relatively large pipe section (typically 18⅝" O.D.) with a top and bottom section for connecting the riser to two other risers at each end, thereby forming a vertical series or string of risers ultimately extending between the sea bottom and the drilling vessel. Each riser typically also includes four small pipes extending axially of the riser from end to end and circumferentially spaced around the main central pipe section at approximately 90° intervals. Two of these pipes are circumferentially spaced 180° and serve as a kill line and/or choke line, respectively, for conducting and delivering mud or the like to the blow out preventer to appropriately control pressure in the well hole thereby preventing or stopping a blow out of the well. The other two pipes on each riser are generally hydraulic supply lines Typically the blow out preventer stack has at its top a "lower riser package" and a ball joint or flex joint plus a riser adapter. These components make it possible to connect the lowermost riser to the blow out preventer (BOP) whereby a string of risers are connected to the blow out preventer and ultimately extend from the sea bottom to the drilling vessel in a manner so that the riser string may pivot and/or rotate around theoretical "Y axis" extending vertically upward from the well; such movement is required under typical drilling and/or production conditions, and generally up to 10° departure of the riser string from the vertical Y axis is desirable.

For more detailed background information regarding suitable deep water drilling equipment and operations such as herein discussed, reference is made to a brochure published by Vetco Offshore, Inc. of Ventura, Calif. entitled "Deep Water Drilling Equipment" (hereafter called "Vetco Brochure") which contains the following table of contents.

Section I Introduction
a. Introduction to Guidelineless Drilling
b. Operational Sequence Set
Section II Expendable Wellhead Equipment
a. Guidance Unit - Guidelineless
Section III Blowout Preventer System
a. Blowout Preventer Stack
Section IV Marine Riser Systems
a. Lower Marine Riser Package
b. Marine Riser Joints and Buoyancy Kits
c. Upper Marine Riser Package (Said Vetco Brochure is incorporated herein by reference as to background prior art details regarding pertinent apparatus and/or methods not specifically shown or discussed herein.)

In deep water drilling it is generally necessary to desirable to support the weight of the string of risers extending between the vessel and the blow out preventer, including when the B.O.P. is in place on the sea floor. One of the systems for doing this is to provide buoyancy modules attached to each riser, whereby surrounding sea water provides buoyancy forces which sufficiently vertically support the string of risers extending from the BOP on sea floor to the vessel at the surface.

Also, in a typical deep water drilling system, a pair of control cables extends from the vessel to the BOP to control and operate various components of the BOP system; such control cables may be designed for electrical or hydraulic control of the blow out preventer system. Each control cable generally extends from one of two winches mounted on the drilling vessel so that the control cable having its lower end connected to the BOP can be raised or lowered by each respective winch as necessary or desirable. Generally such control cable winches are mounted on a column stabilized semisubmersible drilling vessel below the main deck and above the spider deck.

When drilling in deep water exceeding 1,000 ft, and especially in depths of 3,000–6,000 ft, the elongated control cables for the BOP have a substantial weight. It therefore has been found necessary or desirable to supplement and reduce the load imposed on the control cable winches (and on upper portions of the control cables) by clamping each control cable to the above discussed risers, thereby utilizing the buoyancy force provided by the buoyancy modules on the risers to support at least partially the weight of such control cables. This also makes it possible to reduce winch capacity which is generally desirable.

Besides using such risers and the resultant riser string to lower the blow out preventer (BOP) to the sea floor as above discussed, the riser string and control cables supported by same establish an operational arrangement for conducting drilling operations and controlling the well from the vessel, in a manner known to those skilled in the art (see for example aforementioned Vetco Brochure). Additionally, for maintaining the operational drilling system it is sometimes necessary or desirable to lift the risers back up onto the drilling vessel together with the control cables; as, for example, to retrieve the lower riser package and an associated upper portion of the BOP stack for purposes of servicing, maintenance, replacement or the like.

When the B.O.P. stack is being lowered with the risers as above discussed, a typical operational sequence includes the following: The blow out preventer stack (BOP) is mounted on the spider deck of the vessel below the main deck. A first riser is lowered through the rotary on the drill floor of the derrick on the vessel, and the lower end of that riser is connected to the BOP riser adapter by men working on the spider deck. Sometimes this first and lowest riser is not of standard riser length (e.g. 50 ft) to adjust for the distance between the sea bottom and the mean waterline, including an adjustment for tide (such a lower-most non-standard riser is sometimes called a "pup joint"). At the drilling floor of the derrick on the vessel, the lower portion of another riser is connected to the upper portion of the previously installed riser; and the thus-connected risers are lowered through the rotary. A string of risers are successively built-up in this way and lowered with the BOP stack, in a manner known in the art. Two control cables are also fed from the aforementioned winches located below the main deck and clamped to the kill and choke lines respectively by two men working on the spider deck, whereby such control cables are lowered with the riser string and BOP stack. This is accomplished by each man clamping one control cable to a kill line or choke line of a riser by means of a cable clamp made and used according to the prior art or made and used according to this invention, as further discussed below. In raising the risers to lift the riser string and upper part of the blow out preventer onto the vessel, as for maintenance or the like, the above discussed operations are reversed. Particularly, the risers are sequentially raised through the rotary on the drill floor of the derrick on the vessel and there disconnected; and the men on the spider deck sequentially remove the cable clamps from each riser section so that the control cables may be reeled on the respective winches.

It is necessary that each riser can be raised and lowered through the standard rotary on the drill floor of the derrick without damaging any part of the risers and/or rotary, and without otherwise hindering operations at the rotary. The rotary has an opening of fixed maximum diameter, which generally is 49½ inches. Practical considerations for efficient operations require suitable minimum clearance between the rotary opening periphery and all parts of all risers, e.g. to avoid problems due to roll and/or pitch motion of the drilling vessel relative to the riser string. Therefore, trade practice requires that all risers and components thereof, and all items mounted on same, must be disposed within a maximum diameter of 40 inches. That is, it is commercially unacceptable to have any component of a riser, or anything mounted on a riser, extend radially outward from the central axis of the riser more than 20 inches. This limitation is particularly applicable to any control cable clamps or portions thereof mounted on the riser kill line and/or choke line (or any other parts of the risers) for supporting and/or raising and/or lowering the control cables for the BOP, as above discussed.

The most pertinent prior control cable clamp arrangement presently known to applicant is a control cable clamp made by or for Regan Offshore International, Inc. of Torrance, Calif. and supplied by that company to applicant's assignee, Santa Fe International Corporation of Orange, Calif., for use on a drilling vessel "Pacnorse" operated in a joint venture in the North Sea by Santa Fe Drilling Company which is a division of Santa Fe International Corporation (such clamp is sometimes hereafter called the "prior art control cable clamp").

Such prior art control cable clamps involve a number of serious problems and shortcomings from the view point of different construction, mode of operation and results, and also involves materially different concepts, although directed to solving like problems as the present invention of this application.

One substantial problem encountered with such prior art control cable clamps is that they require two-step operations for mounting a clamp subassembly on the riser's kill line and choke line and for separately clamping each cable to such clamp subassembly; and a similar two-step operation in reverse is required for disengagement of the clamp subassembly from the riser and unclamping the control cable to reel same on its winch. Alternatively, the control cable must first be clamped or unclamped with respect to the movable clamp subassembly, which movable subassembly must then be installed on or removed from the clamp portion fixed on the riser. These relatively complex multi-step time consuming clamping and unclamping operations for reeling out or reeling in the control cables are carried out by two men stationed on the spider deck which is a relatively exposed position and can be hazardous if the seas are moderately heavy or greater. Also it is necessary for the two men on the spider deck to manually remove from the risers a rather large and cumbersome clamp subassembly in order that all remaining components on the riser are within the above discussed 20 inch radial maximum distance from the central axis of the riser to assure unhampered raising and/or lowering of the risers through the rotary on the drill deck as above discussed. Such multi-step operations which are quite cumbersome and time consuming thereby slow the overall operation of the drill rig and drilling vessel, thereby adversely penalizing the overall well drilling system which has a very high cost of operation per unit time. Furthermore, such prior art control cable clamps contain clamping components which are not as sturdy or reliable as desired (and achieved according to the present invention). Still further, such prior art control cable clamps are not readily and suitably adjustable to accommodate for variations in manufacture and/or due to wear and tear from using the cable clamps and/or due to variation in the control cables because of manufacturing tolerances and/or usage. Other disadvantages of such prior art control cable clamps and the resultant substantial problems and adverse penalties imposed by the same on the overall offshore drilling system and its operations in very deep water will be apparent to those skilled in the art in light of the explanation herein with reference to the present invention disclosed and claimed in this application.

It is an object of this invention to provide a new improved control cable clamp and riser system, and components thereof, and a new improved system and method of using same, which avoid above discussed and other shortcomings of the best known prior art and provide many significant improvements and advantages by virtue of utilizing new and different concepts, constructions, modes of operation and results, as shown below and as will be apparent to those skilled in the art in light of the disclosure of this application.

SUMMARY OF THE INVENTION

The cable clamp is comprised of two portions, a fixed portion which remains secured to the kill or choke line and a removable portion which can be quickly engaged to or released from the fixed portion to secure or disengage the control cable. The fixed portion includes two main parts which can be secured to one another around the kill or choke line of the riser and thus hold the fixed portion onto such line and riser.

The fixed subassembly includes resilient means for clamping the control cable to the fixed portion of the clamp in conjunction with complementary means which is carried by the bracket and a removable clamp portion which can be quickly assembled or released and which includes a member carrying a cooperating resilient pad for engaging the control cable. The cable engaging surface of each such resilient pad defines a curved portion having a radius of curvature substantially identical to that of the control cable which is to be clamped.

The removable clamp portion has extending from one side of same hinge elements defining a hinge pin hole for receiving a hinge pin. A pin can be placed through the holes to hingedly secure a removable portion to a fixed portion. The pin used to hingedly secure the removable portion to the complementary member is a round bar having a spring at one end and a lock member at the other end such that the pin can be maintained in position until the lock member is disengaged. On the opposite side of said removable portion there extends a flange which defines a slot for receiving bolts for securing the removable portion to the fixed portion to secure a control cable between the complementary means of the fixed clamp subassembly and removable clamp subassembly. A nut internally threaded to threadedly receive each bolt is secured to part of the fixed subassembly so that as the bolt is threaded into place the removable clamp portion is tightened down to frictionally hold the cable against the fixed clamp portion. The removable clamp portion further includes a handle so that it can be easily grasped and installed or removed as desired. In withdrawing the removable portion, the bolts are simply unscrewed from the complementary means, the hinge pin is removed from the hinge element and the removable portion is then released from the fixed portion. To secure the cable in place, this series of operations is reversed.

BRIEF DESCRIPTION OF THE DRAWINGS

FIG. 1 is an enlarged vertical elevation view of one of the risers used in an above-described offshore drilling system wherein the drilling vessel at the ocean surface is connected by a series of such risers to a blow out prevention system (BOP) at the sea floor as above discussed.

FIG. 2 is a partial cross sectional view of FIG. 1 taken along lines 2—2 of FIG. 1.

FIG. 3 is a partial cross sectional view of FIG. 1 taken along line 3—3 in FIG. 1 and showing a novel control cable clamp according to the present invention on one of the kill or choke lines of the riser.

DESCRIPTION OF PREFERRED EMBODIMENT

Figure 4:
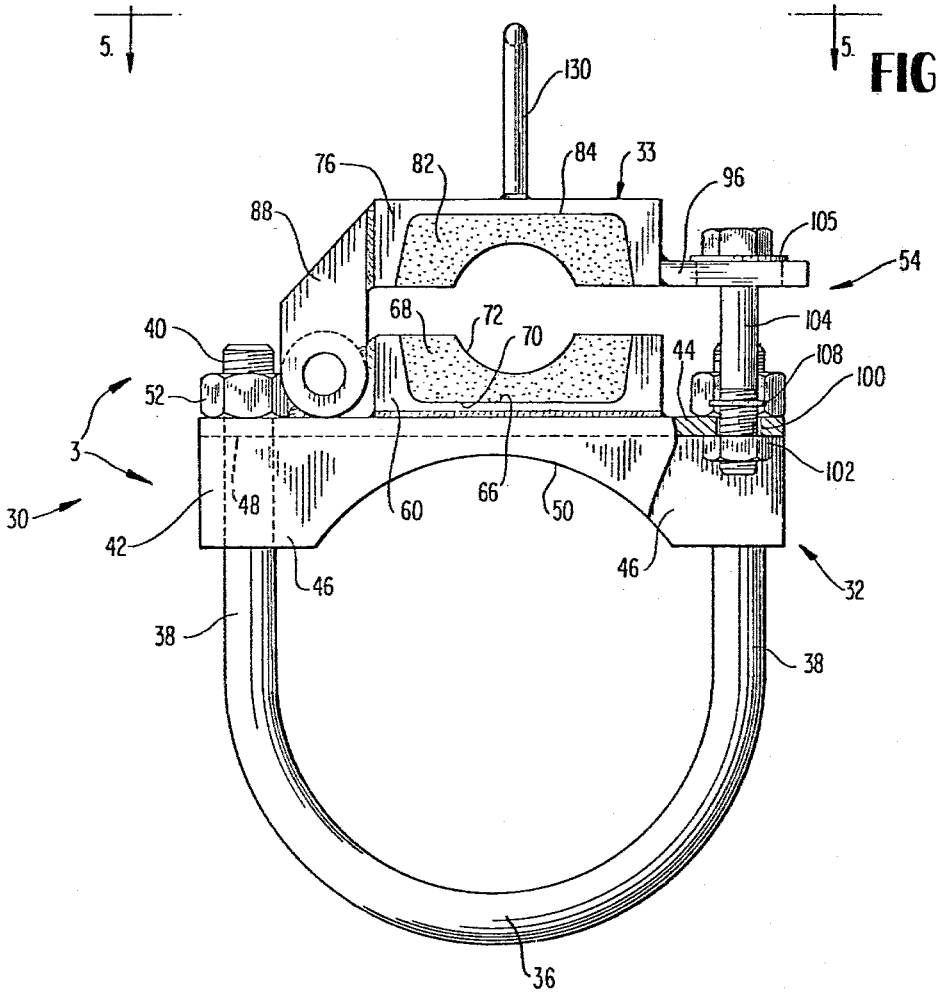
FIG. 4 is an enlarged top plan view (partly sectional) of the novel control cable clamp shown in FIG. 3.

There is shown in FIG. 1 one of a series of marine risers indicated by numeral 1, which risers are attached to one another seriatum for the drilling vessel to the sea floor. At the sea floor, the bottom-most marine riser 1 is secured to a blowout prevention system (BOP) which includes a system of valves, lines, etc., to control the bore hole pressure and the well. Two control cables are used to monitor and control various elements of the BOP at the sea bottom. These cables are secured to the risers 1 of the riser string; and FIG. 3 shows one of such cables indicated by numeral 2 attached to the kill line or choke line (20 or 22) of a riser 1 by means of a control cable clamp according to this invention, which is generally indicated by numeral 3.

Referring particularly to FIG. 1, each riser 1 used to make up the marine riser string is comprised of a central enlarged main pipe 4 extending between an upper riser connecting portion 5 and a lower riser connecting portion 6. The lower riser connecting portion 5 is adapted to be connected to the upper end portion 4 of a prior-installed riser 1, and such operation is repeated seriatum to form a riser string in a manner known in the art as above discussed. Each riser 1 includes a pair of hydraulic lines 17 and 18 spaced 180° apart, and also a kill line 20 and a choke line 22 which are spaced 180° apart and operate in conjunction with the BOP to control pressure at the well head. Lines 17 and 18 are at 60° intervals respectively from lines 20 and 22. Such lines 17, 18, 20 and 22 included on each riser 1 connect with corresponding hydraulic and kill and choke lines on each of adjacent like risers disposed above and below riser 1 to ultimately form a continuous path for each such line from the drilling vessel at the ocean surface to the BOP at the sea floor via the riser string. The kill line 20 generally is used for the delivery of mud to the BOP to neutralize bore hole pressure, while the choke line 22 generally is employed to relieve pressure in the well hole when a potential blowout exists. The hydraulic lines 17 and 18 are used to operate various components of the BOP in a manner known in the art. (As to operation of lines 17, 18, 20 and 22, see aforesaid Vetco Brochure).

Since the depth of the ocean to the BOP is large, a pair (or other number) of buoyancy modules 24 are used on each riser 1 to aid in vertically supporting the marine riser string between the sea floor and the drilling vessel. From FIGS. 1-3, it can be seen that a buoyancy module 24 is formed from two like buoyancy sections 23 which are configured so that two sections 23 substantially completely encircle the main pipe section 4 of riser 1. The sections 23 of buoyancy modules 24 are held in place by one or more bands 26, each being held onto the riser 1 by band clamps 28. When drilling in such great depths, the two control cables 2 which extend from the drilling vessel to the BOP on the sea floor are of such length and weight that the winches for moving and holding each of control cables 2 with respect to the sea floor should not be solely relied upon to support the weight of the cable length involved. To overcome this problem, each of the two control cables 2 is clamped to the kill line 20 or choke line 22 on opposite sides of the risers 1 comprising the riser string to take advantage of the lift provided by the buoyancy modules 24 of such string of risers 1. A clearance is provided between sections 23 of buoyancy modules 24 on each riser 1, as shown at 8 in FIGS. 1-3, to accommodate a control cable clamp 3 on the kill line 20 and on the choke line 22, respectively, for clamping each of the two control cables 2 as especially shown in FIG. 3.

Referring to FIGS. 3-6, in this preferred embodiment, a cable clamp generally indicated by numeral 3 is used to attach a control cable 2 to the kill and choke line 20 and 22 of each riser section 1 when riser 1 is of standard 50 ft length. Any suitable number of cable clamps may be used as desired; use of risers 1 having a length greater than 50 ft may require additional clamps to maintain the cables 2 properly secured in place; or cables 2 may be supported by less than one clamp per riser when using 50 ft risers.

As shown in FIGS. 3-4, the buoyancy module sections 23 generally are spaced from the main pipe 4 of riser 1 by spacers 27. Each buoyancy section 23 of the module 24 has recesses provided at 8 for accommodating the kill and choke lines 20 and 22 and recesses provided at 9 for accommodating the hydraulic lines 17 and 18 so that the buoyancy modules 24 can be fitted snugly about the riser 1. As noted, buoyancy module sections 23 are held in place by bands 26 and clamps 28, with each band clamp 28 being located in one of the recesses 8 which are provided between buoyancy module sections 23 to accommodate a kill line and choke line respectively. The novel cable clamp 3 includes a fixed clamp subassembly 32 which fits in the space defined by the recesses 8 so that this fixed clamp subassembly 32 is wholly within the permissible maximum O.D. of the risers 1 (e.g. within a 20 inch radius from the axis of riser pipe 4); whereas fixed clamp subassembly 32 also is exposed for easy access for clamping of cable 2 to riser 1 by an operator on the spider deck, as further discussed below.

Referring particularly to FIGS. 3-7 which contain a more detailed showing of the novel cable clamp 3, it can be seen that the cable clamp 3 comprises two portions or subassemblies, namely said fixed clamp portion or subassembly 32 and a removable clamp portion or subassembly 33. The fixed clamp portion 32 includes a U-bolt 34 having a semicircular portion 36, which has a radius of curvature substantially equal to that of the kill line 20 and choke line 22, with arms 38 extending from the ends of semicircular portion 36 subtantially parallel to each other and lying substantially in the same plane as the semicircular portion 36; the ends of parallel extension arms 38 include threaded portions 40. The fixed clamp subassembly 32 also includes a bracket 42 of channel-shaped cross section including a bottom plate 44 with two side plates 46 extending laterally therefrom. The bottom plate 44 contains two holes 48 suitably sized and equally spaced from the sides 46 and spaced from each other to register with and receive threaded end portions 40 of parallel extension arms 38 of U-bolt 34, whereby the bracket 42 can readily be assembled on the extension arms 38 of U-bolt 34. The side plates 46 of bracket 42 are cut away to provide curved concave surfaces 50 which have a radius of curvature substantially the same as that of semicircular portion 36 of U-bolt 34. The radius of curvature of both said U-bolt section 36 and said concave recesses 50 of bracket 42 are correlated to the diameter of kill and choke lines 20 and 22 so that U-bolt 34 and bracket 42 will be suitably secured to kill or choke line 20 or 22 by means of two internally threaded nuts 52 which are provided for securing the bracket 42 onto the extension arms 38 of U-bolt 34, thereby securing the fixed control clamp subassembly 32 onto the kill line 20 or choke line 22. In securing the fixed clamp subassembly 32 on the riser 1, nuts 52 threaded onto U-bolt end portions 40 are turned down with sufficient torque to cause the curved surface 50 of bracket 42 and curved surface 36 of U-bolt 34 to engage arcuate portions of the kill or choke line 20 or 22 with sufficient resultant force therebetween so that the fixed cable clamp subassembly 32 is suitably mechanically secured to the riser 1 via the kill or choke line 20 or 22 and is capable of supporting a section of cable 2 when the removable clamp subassembly 33 is affixed as below discussed.

The fixed cable subassembly 32 also carries a cable engaging means which is indicated at 54 and comprises a channel shaped member 60 welded or otherwise fixedly secured to the bracket 42; channel member 60 includes a bottom or base portion 64 with two side portions extending laterally from an inner surface 66 as shown. Channel 60 receives a resilient pad 68 made of rubber or other suitable material and having an outer surface 70 which is substantially identical in configuration and size with the inner surface 66 of said channel-shaped member 60; resilient pad 68 is glued or otherwise secured to the inner surface 66 of said member 60. The resilient pad 68 further includes a concave cable engaging surface 72 which has a radius of curvature substantially the same as, but preferably slightly smaller than, the radius of curvature of the control cables 2 which will be secured onto the risers 1 by the control cable clamp arrangement 3 as herein discussed.

As shown particularly in FIG. 6, fixed cable clamp subassembly 32 also includes a pair of cylindrical or like lugs 92 secured to the outer side of web 44 of bracket 42 with a circular aperture 93 extending through each lug 92; apertures 92 are sized and aligned to receive a hinge pin 112 for mounting the removable cable clamp subassembly 33 on fixed cable clamp subassembly 32, as below discussed.

Particular reference is now made to the removable control clamp portion or subassembly generally indicated by number 33, with special reference to FIGS. 3–7. Movable clamp subassembly 33 includes a main channel-shaped body 76 having a web section 78 and two sides 80 and 81 extending laterally therefrom; the components of movable clamp body 76 are substantially similar in configuration and size to the corresponding parts of the channel shaped support member 60 of fixed clamp subassembly 32. Movable channel shaped member 76 also carries a pad 82 of rubber or other suitable resilient material; pad 82 has an outer surface 84 matching and secured by glue or otherwise to the inner surface of the channel member 76. Pad 82 also has a concave interior surface **82*a* for engaging the control cable 2; surface 82*a* has a radius of curvature similar to, but slightly smaller than, the radius of curvature of control cables 2. When the fixed cable clamp portion 32 is secured to the kill or choke line, 20 or 22, and the movable clamp portion 33 is secured to fixed clamp subassembly 32 as below amplified, the control cable 2 is held within arcuate surfaces 72 and 82*a* of resilient pad 68 and 82. Thus, when fixed support member 60 and movable support member 76 are locked in place together, as below discussed, the generally cylindrical cable 2 is firmly held on riser 1 by cooperating arcuate resilient pad surfaces 72 and 82*a*** which have substantially the same radial axis position as the cable's axis.

Referring especially to FIGS. 6 and 3–5, main channel shaped member 76 of the removable clamp subassembly 33 is provided with two like flanges 88 extending from channel side 81, each flange 88 having a circular aperture 90 therein; apertures 90 are aligned and sized to receive hinge pin 112 as below discussed. Flanges 88 of movable clamp subassembly 33 are designed to overlap lugs 92 of fixed clamp subassembly 32 so that hinge pin holes 93 register with hinge pin receiving holes 90. A hinge pin 112 is used for hingedly securing the removable subassembly 33 to the fixed subassembly 32.

Figure 6:
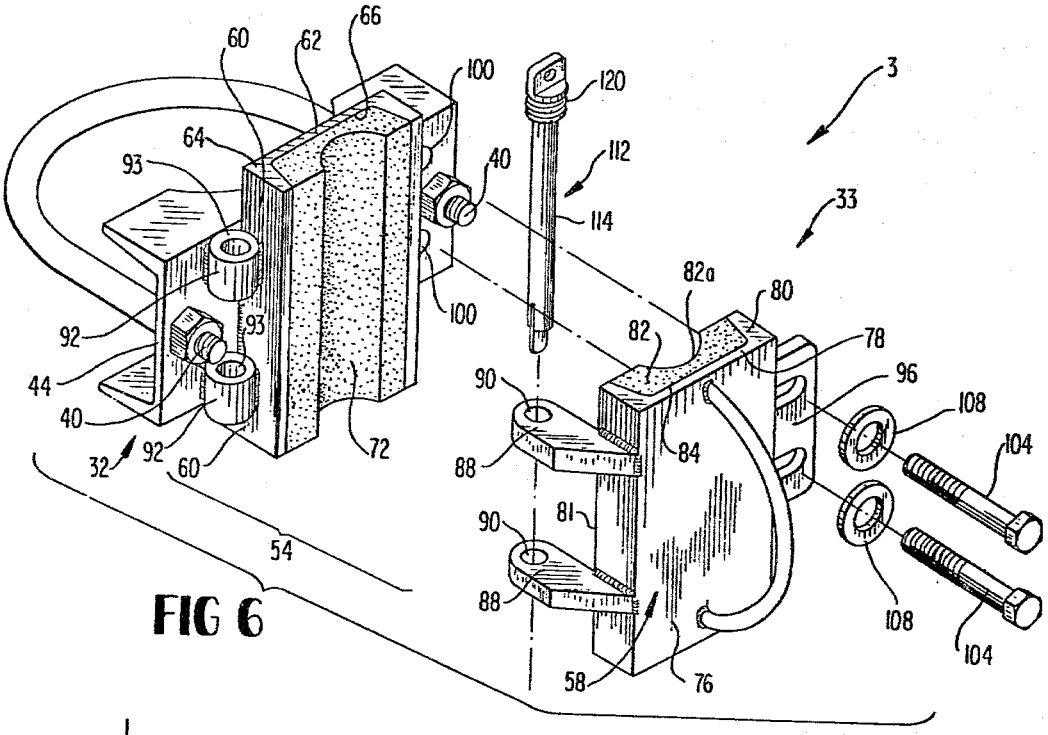
FIG. 6 is an exploded view of the cable clamp shown in FIGS. 3–5.
Figure 7:
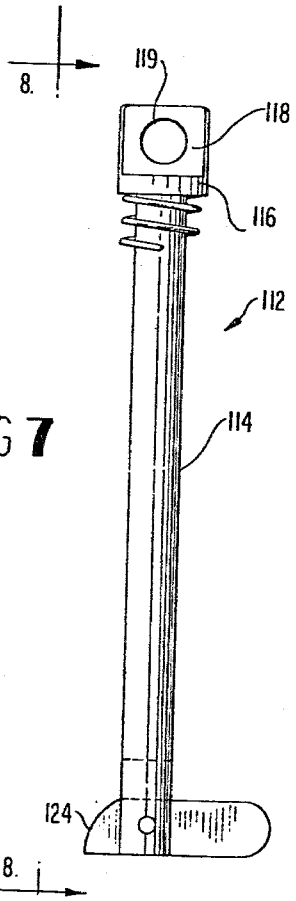
FIG. 7 is an enlarged elevation of the hinge pin used to connect the removable cable clamp subassembly from the fixed cable clamp subassembly secured to the riser's kill or choke line.
Figure 8:
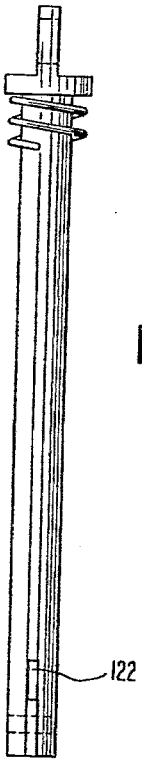
FIG. 8 is an elevation view of the pin of FIG. 7 (looking in direction of arrows 8—8 in FIG. 7).
Figure 9:
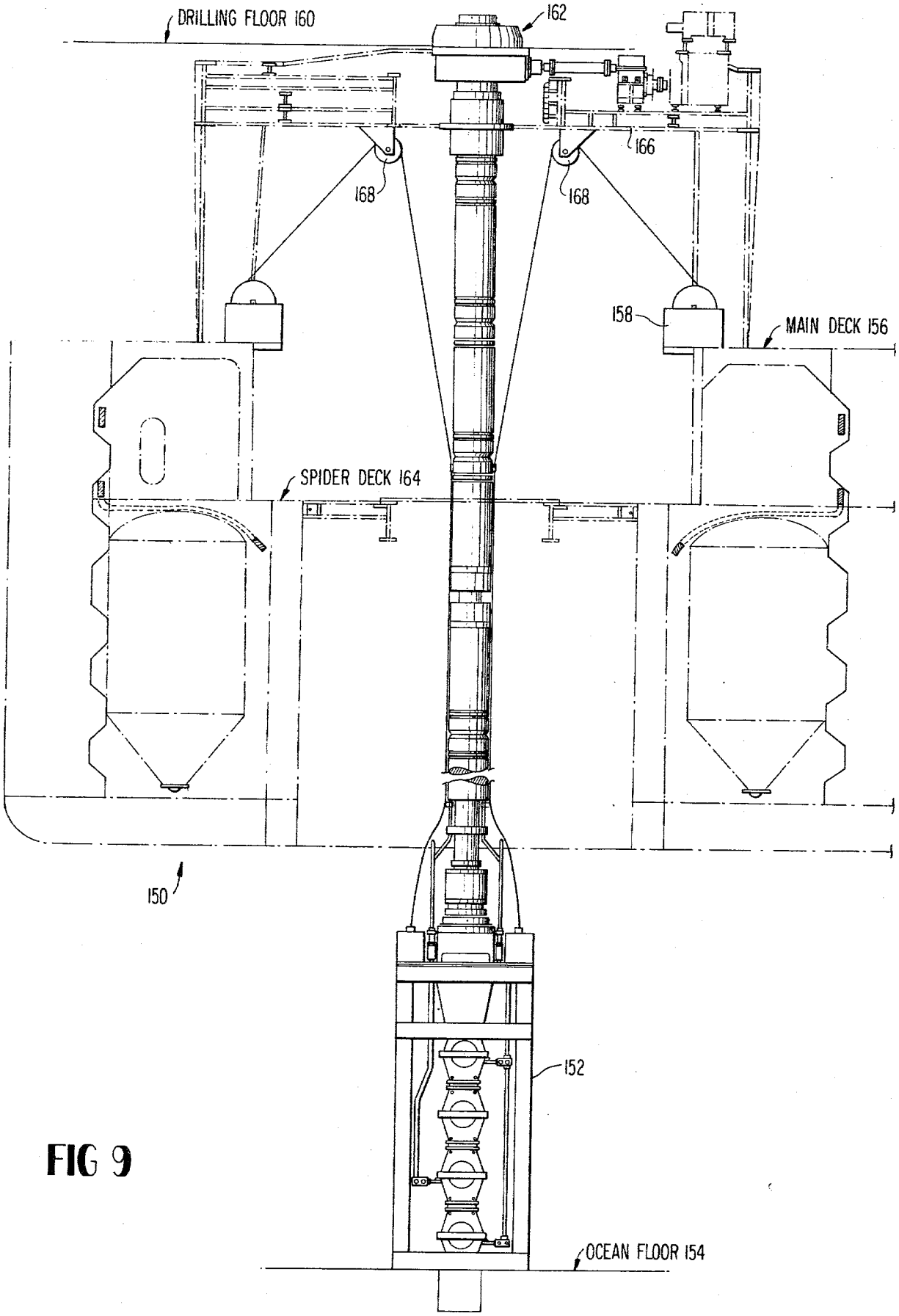
FIG. 9 is a diagramatic elevation of a riser string incorporating features of this invention extending from the surface vessel to the ocean floor.

Referring especially to FIGS. 6–8, hinge pin 112 is comprised of a rod 114 which has a retaining ring 116 at one end with flange head portion 118 extending therefrom and having an aperture 119 therein, said rod 114 having a slot 122 at the other end. A spring 120 is provided to engage the retaining ring 116 and cooperatively act with a lock tooth 124 pivotally mounted in slot 122 to secure the pin 114 in place in cooperating hinge holes 90 and 93 of cooperating hinge parts 88 and 92. The pin lock tooth 124 is movable within said slot 122 to a horizontal position and is of such length that it then extends beyond the circumference of the bracket hinge holes 90 of flanges 88 of movable clamp subassembly 32. The lock tooth 124 has a width which is no greater than the diameter of the round rod 114 of the pin 112 whereby in the aligned position the lock tooth 124 can fit readily through the hinge pin receiving holes 90 of the flanges 88 and the hinge pin receiving holes 93 of the lugs 92. Once the pin 112 has been extended entirely through such holes 90 and 93 of such flanges 88 and members 92, the lock tooth 124 is then turned to a horizontal position as shown in FIG. 7. The spring 120 will be under compression due to the retaining ring 116 and that will maintain the hinge pin 112 secured by lock tooth 124 to thereby hingedly mount the movable clamp subassembly 33 on the fixed clamp subassembly 32, until pin 112 is released and removed by the operator in a manner apparent to one skilled in the art in light of the disclosure herein.

Figure 5:
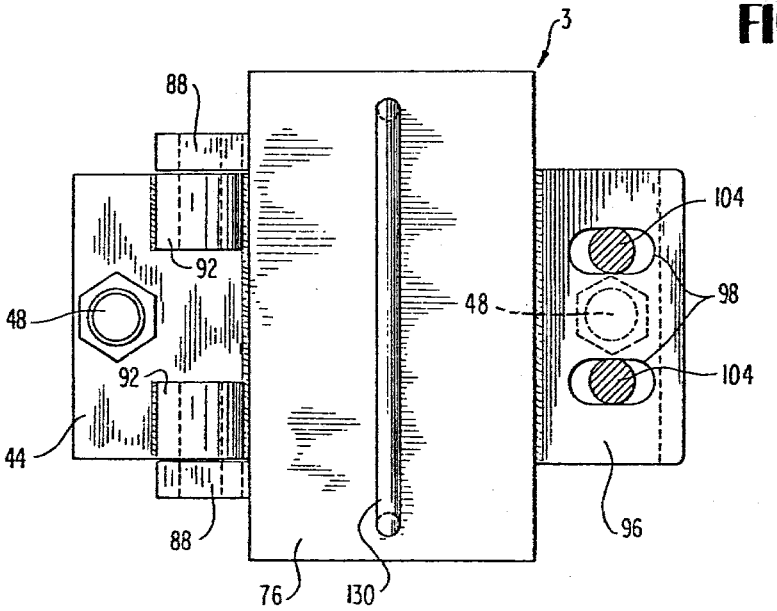
FIG. 5 is a side elevation view of the cable clamp shown in FIG. 4 (looking in the direction of arrows 5—5 in FIG. 4).

Reference is now made especially to FIGS. 4–6. Extending from the opposite side 81 of the channel-shaped member 76 of the movable clamp subassembly 33 is a plate 96 having two elongated bolt slots 98 therein which are also spaced from each other for receiving securing bolts 104. The web 44 of bracket 42 of fixed clamp subassembly 32 has a pair of bolt holes 100 which register with the bolt slots 98 so that a securing bolt 104 inserted through the slots 98 may also be inserted through such bolt holes 100 in bracket member 42. The bracket member 42 further supports a pair of internally threaded nuts 102 each welded or otherwise secured adjacent and concentric with said bolt holes 100 so that the each bolt 104 of movable clamp subassembly 32 can be secured directly to the bracket 42 of fixed clamp subassembly 33 by being threadedly secured in one of the nuts 102. Each bolt 104 carries a retainer clip 108 which ensures that the bolts 104 will remain with the removable clamp subassembly 33 when it is released from the fixed clamp subassembly 32. A washer 105 preferably is also used intermediate head 106 of bolt 104 and the plate 96.

In cable removing operation, the securing bolts 104 on the movable clamp subassembly 32 are simply unscrewed from the threaded nuts 102 on the bracket 42 of the fixed clamp subassembly 33. Because of the retainer clips 102, the bolts 104 will remain connected to the removable clamp subassembly 33 when it is pivoted about hinge pin 112 to open the cable clamp 3 for removal of a section of cable 2 from a riser 1; thereupon such cable section can be reeled onto its winch. Then the hinge pin 112 is pressed against the spring 120 a sufficient distance to allow the lock tooth 124 to be moved to a position within slot 122 aligned with the axis of pin shaft 114. In this disposition the hinge pin 112 can be removed from the apertures 90 and 93 of the hinge elements 88 and 92, thereby allowing the removable clamp subassembly 33 to be released and removed from the fixed clamp subassembly 32. Main member 76 of movable clamp subassembly 32 is provided with a handle 130 (particularly shown in FIGS. 4–6) to permit ready removal and disposition of said clamp subassembly 32 by an operator on the spider deck of the drilling vessel. A safety wire (not shown) can be secured to the cable clamp handle 130 and to the hole 119 in flange 118 of pin 112 to keep the locking pin 112 secured to its respective removable cable clamp subassembly 33. The described procedure is reversed when a cable 2 is to be clamped back on to a riser 1 for lowering of the BOP and control cables 2 to the sea floor. By using this approach, a substantial amount of time is saved in engaging and disengaging each section of control cables 2 to and from the risers 1.

It should be noted as shown in FIG. 3 that no part of the fixed control clamp subassembly 32 extends beyond the outer diameter defined by the buoyancy module 24 of riser 1. Therefore, once the removable cable clamp subassembly 33 is released from the fixed portion 32, the clamp portion 32 and all elements thereof remaining on riser 1 can pass readily through the rotary opening in the drill floor of the derrick on the drill vessel.

The control cable clamp 3 is designed to support on riser 1 the weight of a section of control cable 2 by friction of the concave portions 72 and 82*a* of resilient inserts 68 and 82 against the engaged portion of control cable 2 without significant compressive force against the control cable; that avoids damage to the control cables 2 and the components thereof by usage of cable clamp 3. The arrangement for pivoting and securing the movable clamp subassembly 33 with respect to the fixed clamp subassembly 32 (particularly as shown in, and described with, reference to FIGS. 4 and 5) makes it possible to adjust readily for variation in sections of the control cables 2 which often are not truly cylindrical and not always according to nominal manufacturing dimensions. Such clamp arrangements according to this invention also makes it possible to adjust readily for wear and tear on components of the resilient cable engaging inserts 68 and 82 and other elements of the cable clamp 3; for example, such adjustment can readily be effected by adjusting the degree of turndown and torque on the bolts 104 which are permitted to tilt in relation to slots 98 when locking the movable clamp subassembly 33 to the fixed clamp subassembly 32 to retain a section of cable 2 therebetween.

The use of channels 60 and 76 to hold rubber cable engaging inserts 68 and 82 and providing space between adjacent portions of such inserts and channel members also enables easy and effective adjustment of the cable clamp according to wear and tear or other pertinent factors.

It is noted that the control cable clamp 3 of this invention is made using standard structural steel channels particularly for components 42, 60 and 76, with suitable modification of such standard channels by low cost machining processes. This and other novel aspects of cable clamp 3 and its components make it possible to produce the cable clamp 3 at relatively low cost, while achieving good operational characteristics and advantages as above discussed.

As shown, the string of risers 1 extends between the vessel 150 and the BOP 152 located on the ocean floor 154. The control cable 2 must also span this distance to monitor and control various components on the BOP 152 from a convenient position on the vessel 150. When operating in deep water, the length of cable 2 can be of substantial weight requiring apparatus of unusual capacity in retrieving and paying out the cable 2 during the forming and retrieving operations. To keep this capacity within more reasonable limits, the cable 2 is clamped to risers 1 as they are being lowered to the ocean floor 154. This utilizes the buoyancy of the modules 24 to offset at least partially the weight of the cables 2. Since the cost of drilling operations are inordinately high, any savings in time can result in correspondingly significant savings in cost. Accordingly, the system employed herein for the clamping and unclamping operation is one which keeps this time to a minimum while also advantageously reducing the capacity of associated apparatus.

The system employed for this purpose will now be described in more detail. A semi-submersible vessel 150 includes a main deck 156 on which two winches 158 are spaced from each other on either side of the riser string. Located vertically above the main deck 156 is a drill floor 160 which carries a rotary 162 utilized in connecting the risers 1 to each other. Beneath the main deck 156 is a spider deck 164 where the clamping and unclamping operation takes place. Just beneath the drilling floor 160 is a platform 166 which supports some of the apparatus which operates the rotary 162. Two sheaves 168 are carried in the underside of this platform 166 in spaced relationship to each other on opposite sides of the riser string. These sheaves 168 lie in substantially the same plane as the winches 158, but are located at a position intermediate the riser string and the winches 158. In this way, the cable 2 can be looped over the sheaves 168 and extended to a position adjacent a riser 1 at the spider deck 164 where the clamping and unclamping operation takes place.

The above described apparatus maintains the portion of the cable 2 not directly involved in the clamping or unclamping operation properly located above the workers to avoid interference with them in performing their operations. The winches 158 and sheaves 168 could be located elsewhere so long as the cable 2 is maintained in a non-interfering disposition.

When the BOP 152 is being lowered to the sea floor the series of risers are connected one upon another until a string of risers 1 is formed having a cumulative length which extends the entire distance between the vessel 150 and the ocean floor 154. This is accomplished by first delivering the BOP 152 to a position on the spider deck 165 where a riser 1 can be attached to the top portion of the BOP. From the derrick the riser 1 is lowered through the rotary 162 until it is in a position for engagement with the BOP 152. Once the BOP 152 has been attached to the first riser 1, it is lowered a sufficient distance so that the top of the first riser 1 is in position for engagement with a second riser 1.

As each riser 1 is moved downwardly to complete another connecting operation at the rotary 162, a previously connected riser 1 naturally is lowered into position on the spider deck 164 where the control cables 2 are secured to a kill line 20 and a choke line 22. To this end the portion of the cable 2 adjacent its respective line 20,22 is placed into the fixed cable subassembly 32 by workers on either side of the riser string and then clamped on with the removable portion 33 of the clamp assembly 3. As the riser string or series continues to move downward in this process, the cable 2 will be paid out from each winch 158 and over each sheave 168 such that there is always a continuous length of cable 2 available for securing to the string. In this manner, once the string has achieved a length to span the distance between the vessel 150 and the ocean floor 154, the cable 2 will similarly connect the appropriate apparatus on the BOP 152 to the appropriate control mechanism on the vessel 150.

In retrieving the BOP 152 and the portion of the string between the vessel 150 and the ocean floor 154, the system described above is simply reversed. As each riser 1 is raised to the level of rotary 162 to allow disconnection, the portion of the control cable 2 secured to the riser 1 at a position adjacent the spider deck 164 is disengaged or removed from its respective riser by quickly removing the removable portion 33 of the cable clamp assembly 3. Once the removable portion 33 has been disengaged from both cables 2 as shown, and the riser 1 is ready for continued movement upward, it is so moved to bring the next riser 1 into position adjacent the spider deck 164 for another unclamping operation. Simultaneously, with this movement the winches 158 are operated to draw up the slack such that the control cable 2 disengaged from the riser 2 will never be an impediment to the remainder of the unclamping procedure.

It should be kept in mind in connection with the overall procedure of raising and lowering a riser string that the engagement and disengagement of the control cable 2 with a riser 1 as it moves through various portions of the vessel is accomplished in a one step process. This one step process results from the unique configuration of a cable clamp and its cooperation with the feature of the riser as described with respect to FIGS. 1–8. Because the fixed portion of the clamp does not extend beyond the outer perimeter of the riser 1 as defined by the buoyancy modules it will not interfere with any porition of the rotary 164 as it is moved upward or lowered through that device during the assembly or disassembly of the string. In addition, significant time is saved because only one device is required in securing or disengaging the cable 2 from the riser 1 unlike the multistep configurations which have characterized the prior art. In view of this unique combination, savings are achieved in time in securing the control cables to the risers, wear and tear and longevity for the cable clamps themselves.

The invention may be embodied in other specific forms without departing from the spirit or essential characteristics thereof. The embodiment described above is therefore to be considered in all respects as illustrative and not restrictive, the scope of the invention being indicated by the hereafter appended claims rather than by the foregoing description, and all changes which come within the meaning and range of equivalency of the claims are therefore intended to be embraced therein.

What is claimed is:

1. A cable clamp for releasably clamping a control cable to a relatively fixed pipe member to secure said cable relative to said member, said clamp comprising:

a fixed portion, said fixed portion being adapted to be secured in a fixed disposition relative to said pipe, said fixed portion further comprising a pipe clamp member, a bracket member, said pipe clamp member including a U-bolt adjustably secured to said bracket, said U-bolt including a semicircular bar having a radius of curvature substantially identical to the pipe to which it is to be fixed and having two arms extending in parallel disposition from the ends of said semicircular bar, a portion of said bar configured to engage said pipe, said bracket having a first part for engaging said pipe and a second part for adjustably receiving said bar, said second part of said bracket defining holes for receiving said arms, said arms being threaded at their ends for threaded engagement with complementary threaded means for adjustably securing said bar about said pipe;

said first part of said bracket comprising two plates lying in a plane parallel to the plane defined by said bar, each of said plates further defining a concave curved surface having a radius of curvature substantially equal to the pipe to which it is to be fixed and located opposite said semicircular bar such that the curved surfaces of the plates and the semicircular bar will engage the pipe from opposite directions to secure mechanically the bracket and bar to the pipe as said bar and said plates are drawn toward each other for operation of said complementary threaded means with said threaded ends;

a removable portion;

and said fixed portion carrying a complementary means for cooperating with said removable portion to clamp said cable to said fixed portion;

said removable portion having a cable engaging member; and said complementary means including a complementary cable engaging member;

said removable portion having securing means for releasably securing said removable portion to said fixed portion and for moving said cable engaging member toward said complementary engaging member to secure said cable relative said fixed portion and to move said cable engaging member away from said complementary engaging member to release said cable from said cable clamp, said securing means, said complementary means and said removable portion being sufficiently exposed for access by an operator and said securing means being located relative to said fixed portion for releasing said removable portion entirely in the vicinity of said removable portion.

2. The cable clamp according to claim 1 wherein said removable portion carries a support member for supporting said cable engaging member and said bracket carries a complementary support member for supporting said complementary cable engaging member.

3. The cable clamp according to claim 2 wherein each of said engaging members is formed from a resilient material having at least a portion of said material configured to the outer surface of said cable.

4. The cable clamp according to claim 3 wherein said support member and said complementary support member are each channel shaped in configuration having a bottom web and two side members extending substantially perpendicular therefrom, said side members defining end surfaces which register with the corresponding end surfaces of the complementary member, each of said bottom webs and side members defining inner surface and outer surface, said engaging members being carried by each of said surfaces of said support members.

5. The cable clamp according to claim 4 wherein said securing means includes a hinge member extending from one side of said removable portion for hinged connection to said fixed portion and said complementary means including a complementary hinge member for cooperating with said hinge member on said removable portion.

6. The cable clamp according to claim 5 wherein said hinge member includes at least one flange extending from the side of said removable member and having a hinge hole therein for receiving a hinge pin, said complementary hinge member having at least one cylindrical member which defines a bracket hinge hole for registering with said hole on the flange for hingedly connecting said flange to said bracket when said hinge pin is inserted through said hole and said bracket hinge hole.

7. The cable clamp according to claim 6 wherein said securing means for securing said removable portion to said fixed portion, further includes a plate member extending from the other side of said removable member, said plate member defining at least one slot for receiving the threaded bolt therethrough, the bottom plate of said bracket defining a hole registering with side slot for receiving said bolt, said bracket further defining a threaded portion for threadedly securing said bracket to said bolt.

8. The cable clamp according to claim 7 wherein said bolt carries a retainer clip for retaining said bolt on said removable portion once said removable portion is released from said fixed portion.

9. The cable clamp according to claim 8 wherein said removable portion defines two hinge members vertically displaced from each other, said bracket defines two complementary hinge members registering with said hinge members such that said hinge pin can extend entirely through both said hinge members and said complementary hinge members, and said plate member defining two slots vertically displaced from each other for receiving two threaded bolts and said bottom plate of said bracket defining two holes each having a threaded portion for threadedly receiving said threaded bolts to secure said removable portion to said bracket.

10. A cable clamp according to claim 9 wherein said hinge pin includes means for locking said pin in said hinge members.

11. The cable clamp according to claim 10 wherein said hinge pin further comprises a rod, a flanged top member secured to one end of said rod, a slotted portion at the other end of said rod, said slotted portion at the other end of said rod, said slotted portion having a locking pin pivotally secured therein, said locking pin being rotatable from an open position where a portion of said pin is received in said slot allowing said rod to be placed in and withdrawn from said hinge holes to a closed position where said pin prevents said rod from being placed in or withdrawn from said hinge holes, said rod carrying a spring adjacent said top portion such that when said rod is placed in said hinge holes and said locking pin is moved into the closed position, said spring will be compressed to maintain the tension against said locking pin for locking said rod into position when disengaged by an operator.

12. A cable clamp according to claim 10 wherein said removable portion carries a handle for grasping by the operator to readily remove the removable portion from the fixed portion.

13. The cable clamp according to claim 12 wherein said fixed portion is configured to be secured to at least one of a kill line or choke line on a mud riser and said removable portion and said complementary means being configured to secure a control cable used in connection with said riser to said riser.

14. The cable clamp according to claim 13 wherein said riser carries a buoyancy module which is substantially cylindrical in configuration, said kill line and choke line being located within the outer diameter of said buoyancy module, said fixed portion of said cable clamp being secured to said kill line or choke line such that the outer most elements of said fixed portions lie within the outer diameter of said buoyancy module when said removable portion is released from said fixed position.

15. A cable clamp releasably clamping a cable to a relatively fixed member on a riser wherein said riser includes a main pipe and at least one additional pipe secured adjacent said main pipe, and a buoyancy module substantially enclosing said main pipe and defining a recess for exposing at least a portion of at least said one additional pipe, said recess further configured to accommodate said cable clamp; and said cable clamp comprising:

a fixed portion including a pipe clamp member; a bracket member; said pipe clamp member including a pipe clamp bar adjustably secured to said bracket, a portion of said bar configured to engage said additional pipe; said bracket having a first part for engaging said additional pipe and a second part for adjustably receiving said bar; and means for drawing said bar and said bracket toward each other about said additional pipe to mechanically secure said fixed portion to said additional pipe;

said fixed portion carrying a complementary means for cooperating with said removable portion to clamp said cable to said fixed portion, said removable portion having a cable engaging member;

said complementary means including a complementary cable engaging member;

said removable portion having securing means for releasably securing said removable portion to said fixed portion and for moving said cable engaging member toward said complementary engaging member to secure said cable relative said fixed portion and to move said cable engaging member away from said complementary engaging member to release said cable from said cable clamp; and said fixed portion lying substantially entirely within an outer perimeter defined by said buoyancy module, whereby removal of said cable is accomplished by removal of said removable portion leaving said fixed portion remaining on said additional pipe within the perimeter defined by said module.

16. The cable clamp according to claim 15 wherein said removable portion supports a resilient cable engaging member; said bracket supports a complementary resilient cable engaging member; and said removable portion cooperating with said bracket in a secured positon to clamp said cable between said resilient cable engaging members.

17. The cable clamp according to claim 16 wherein said removable portion and said bracket are configured to accommodate different size cables.

18. The cable clamp according to claim 17 wherein said riser includes a kill line, a choke line, and two hydraulic lines, and said fixed portion is fixed to at least one of said kill and choke lines.

19. A cable clamp for releasably clamping a cable to a relatively fixed member on a riser, wherein said riser includes a main pipe and at least one additional pipe secured adjacent said main pipe comprising:

a fixed portion;

a removable portion;

means for clamping said fixed portion to said additional pipe, and said fixed portion carrying a complementary means for cooperating with said removable portion to clamp said cable to said fixed portion;

said removable portion having a cable engaging member; and said complementary means including a complementary cable engaging member;

said removable portion having securing means for releasably securing said removable portion to said fixed portion and for moving said cable engaging member toward said complementary engaging member to secure said cable relative said fixed portion and to move said cable engaging member away from said complementary engaging member to release said cable from said cable clamp;

said securing means including a hinge member extending from one side of said removable portion for hinged connection to said fixed portion of said complementary means including a complementary hinge member for cooperating with said hinge member on said removable portion;

said hinge member including at least one flange extending from the side of said removable portion and having a hinge hole therein for receiving a hinge pin, said complementary hinge member having at least on cylindrical member which defines a first portion hinge hole for registering with said hole on the flange for hingedly connecting said flange to said fixed portion when said hinge pin is inserted through said hinge holes.

20. The cable clamp according to claim 19 wherein said securing means for securing said removable portion to said fixed portion, further includes a plate member extending from the other side of said removable portion, said plate member defining at least one slot for receiving a threaded bolt therethrough, said fixed portion defining a hole registering with side slot for receiving said bolt, said fixed portion further defining a threaded portion for threadedly securing said fixed portion to said bolt and said removable portion.

21. The cable clamp according to claim 20 wherein said removable portion defines two hinge members vertically displaced from each other, said fixed portion defines two complementary hinge members registering with said hinge member such that said hinge pin can extend entirely through both said hinge members and said complementary hinge members, and said plate member defining two slots vertically displaced from each other for receiving two threaded bolts and said fixed portion defining two holes each having a threaded portion for threadedly receiving said threaded bolts to secure said removable portion to said fixed portion.

22. A cable clamp according to claim 21 wherein said hinge pin includes means for locking said pin in said hinge members.

23. The cable clamp according to claim 29 wherein said hinge pin further comprises a rod, a flanged top member secured to one end of said rod, a slotted portion at the other end of said rod, said slotted portion having a locking pin pivotally secured therein, said locking pin being rotatable from an open positon where a portion of said pin is received in said slot allowing said rod to be placed in and withdrawn from said hinge holes to a closed position where said pin prevents said rod from being placed in or withdrawn from said hinge holes, said rod carrying a spring adjacent said top portion such that when saidrod is placed in said hinge holes and said locking pin is moved into the closed position, said spring will be compressed to maintain the tension against said locking pin for locking said rod into position when disengaged by an operator.

24. A cable clamp according to claim 23 wherein said removable portion carries a handle for grasping by the operator to readily remove the removable portion from the fixed portion.

25. A cable clamp assembly for releasably clamping a cable to a fixed member of a pipeline riser, said fixed member being recessed from the exterior surface of said riser, said cable clamp assembly comprising:

a fixed cable clamp portion;

a removable cable clamp portion;

means for clamping said fixed cable clamp portion to said recessed riser member such that said fixed cable clamp portion is recessed from the exterior surface of the riser;

a first cable engaging member carried by said fixed cable clamp portion to clamp said cable to said fixed portion, a second cable engaging member carried by said removable cable clamp portion for cooperating with said first cable engaging member to clamp said cable to said fixed cable clamp portion; and securing means on said removable cable clamp portion for releasably securing said removable cable clamp portion to said fixed cable clamp portion and for moving said first and second cable engaging members toward each other to secure said cable relative to said fixed cable clamp portion and to move said first and second cable engaging members away from each other to release said cable from said cable clamp.

26. A cable clamp assembly according to claim 25, wherein said fixed cable clamp portion comprises first and second fixed clamp members for clamping said fixed riser member therebetween, said first and second fixed clamp members being recessed from the exterior surface of the riser, one of said fixed clamp members having one face shaped substantially complementary to the shape of the fixed riser member and a second face shaped substantially complementary to the shape of the cable to be clamped.

27. A cable clamp assembly according to claim 26, wherein said securing means comprises hinged coupling means for hingedly coupling said fixed and removeable cable clamp portions for permitting relative pivotal movement of said fixed and removeable cable clamp portions, and locking means for securing said fixed and removeable cable clamp portions to each other in engagement with the cable to be clamped against relative movement therebetween.

28. A cable clamp assembly according to claim 25, wherein said riser includes a main pipe, a buoyancy module substantially enclosing said main pipe and defining a recess in an exterior surface thereof, and at least one additional pipe secured to said main pipe in the recess defined in said buoyancy module, said fixed cable clamp porton being fixed to said at least one additional pipe within said buoyancy module recess.

* * * * *

UNITED STATES PATENT AND TRADEMARK OFFICE

CERTIFICATE OF CORRECTION

PATENT NO. : 4,249,610

DATED : February 10, 1981

INVENTOR(S) : Sven Loland

It is certified that error appears in the above-identified patent and that said Letters Patent is hereby corrected as shown below:

In the References, change "3,963,855" to --3,963,885--.

Column 2, line 31, after "lines" insert a --.--.

Column 2, line 67, after "necessary" change "to" to --or--.

Column 16, lines 50-51, change "positon" to --position--.

Column 17, line 25, change "on" to --one--.

Column 17, line 60, change "positon" to --position--.

Column 18, line 62, change "porton" to --portion--.

Signed and Sealed this

*Twenty-first* Day of *June 1983*

[SEAL]

*Attest:*

DONALD J. QUIGG

*Attesting Officer*

*Acting Commissioner of Patents and Trademarks*